US006239340B1

(12) United States Patent
Heuerman

(10) Patent No.: US 6,239,340 B1
(45) Date of Patent: May 29, 2001

(54) SNARE DRUM SIMULATOR PRACTICE PAD

(76) Inventor: Kevin Michael Heuerman, 8662 Buggy Whip Rd., Alta Loma, CA (US) 91701

( * ) Notice: Subject to any disclaimer, the term of this patent is extended or adjusted under 35 U.S.C. 154(b) by 0 days.

(21) Appl. No.: 09/585,232

(22) Filed: May 31, 2000

(51) Int. Cl.[7] ..... G10D 13/02

(52) U.S. Cl. ..... 84/411 P; 84/415; 84/416; 84/402

(58) Field of Search ..... 84/411 P, 415, 84/416, 411 R, 420, 402

(56) References Cited

U.S. PATENT DOCUMENTS 4,179,974 * 12/1979 Trankle ..... 84/411 P
4,406,207 * 9/1983 Criscione ..... 84/411 P
4,581,972 * 4/1986 Hoshino ..... 84/723

* cited by examiner

*Primary Examiner*—Shih-Yung Hsieh
(74) *Attorney, Agent, or Firm*—Joseph A. Yanny; Michael A. DiNardo

(57) ABSTRACT

Disclosed is a novel apparatus for the practice of use and simulation of a snare drum. The present invention provides a practice drumming pad that can reproduce the sound and feel of a snare drum, thereby allowing the user to practice proper rhythm and technique to produce the desired results when using a real snare drum. The practice pad of the present invention consists of a substrate having a rubber pad on the top surface, a recessed channel in the bottom surface, and a sound generating device consisting of a layer of pellets contained between two rigid plates secured in the recessed channel. The rigid plates and layer of pellets are secured in the recessed channel so as to allow little more than vibrational movement of the plates and pellets in the recessed channel. As one "drums" on the rubber pad, the vibrations are transferred to the plates and pellets to simulate the sound produced by a real snare drum.

14 Claims, 2 Drawing Sheets

SNARE DRUM SIMULATOR PRACTICE PAD

CROSS-REFERENCE TO RELATED APPLICATION

Not Applicable.

STATEMENT RE: FEDERALLY SPONSORED RESEARCH AND DEVELOPMENT

Not Applicable.

BACKGROUND OF THE INVENTION

This invention relates to a musical instrument, and more particularly to a practice drumming pad that simulates the sound and feel of a snare drum that allows a person to practice using a snare drum in a quieter and more easily transportable manner with a high degree of realism.

Practice pads for drums have been available in the prior art for a number of years. The practice pads generally available primarily simulate the feel of a basic drum while producing a severely muted simulation of the sound created by the basic drum. None of the practice pads available, when used alone, can reproduce the sound of a drum, either in quality or volume. Some of the prior art practice pads can be used in conjunction with an actual drum to mute the sound produced by the drum.

Generally available prior art practice pads consist of: a solid material block; a resilient, semi rigid rubber pad on the top-side; and a non-skid surface on the bottom-side. A user could place the practice pad on nearly any surface, including an actual drum, and practice the drumming technique to obtain muscle memory and hone drumming techniques. The muscle memory and drumming techniques transfer for ready use with actual drums.

However, the available practice pads do not allow a person to practice the required rhythmic drumming necessary for effective use of a snare drum. The shortcoming of available practice pads in this respect relates to the inability of a practice pad to simulate the sound of snare drum and thereby let the user know he or she is practicing the correct rhythm or technique.

Therefore, it is an object of the present invention to provide a drum practice pad that reproduces the tonal qualities of an actual snare drum.

It is a another object of the present invention to provide a drum practice pad that reproduces the feel of using an actual snare drum.

It is a further object of the present invention to provide a practice pad for a snare drum that is compact and easily transportable.

BRIEF SUMMARY OF THE INVENTION

The present invention addresses the above shortcomings of the prior art by providing a practice pad that can reproduce the sound and feel of an actual snare drum, thereby allowing the user to practice proper rhythm and technique to produce the desired results when using an actual snare drum. This result is achieved even though the present practice pad does not use any of the components found in a standard snare drum and is much more compact and more easily transportable than an actual snare drum. The practice pad of the present invention consists of a substrate having a top surface and bottom surface. The top surface is covered with a resilient, semi-rigid rubber pad typically used in related prior art devices. The bottom surface has a recessed channel that contains a rigid metal plate in generally the same shape as the channel, a layer of pellets, and another rigid metal plate in generally the same shape as the channel. The metal plates and layer of pellets are all secured in the recessed channel so as to allow little more than vibrational movement of the pellets in the channel.

DETAILED DESCRIPTION OF THE INVENTION

Figure 1:
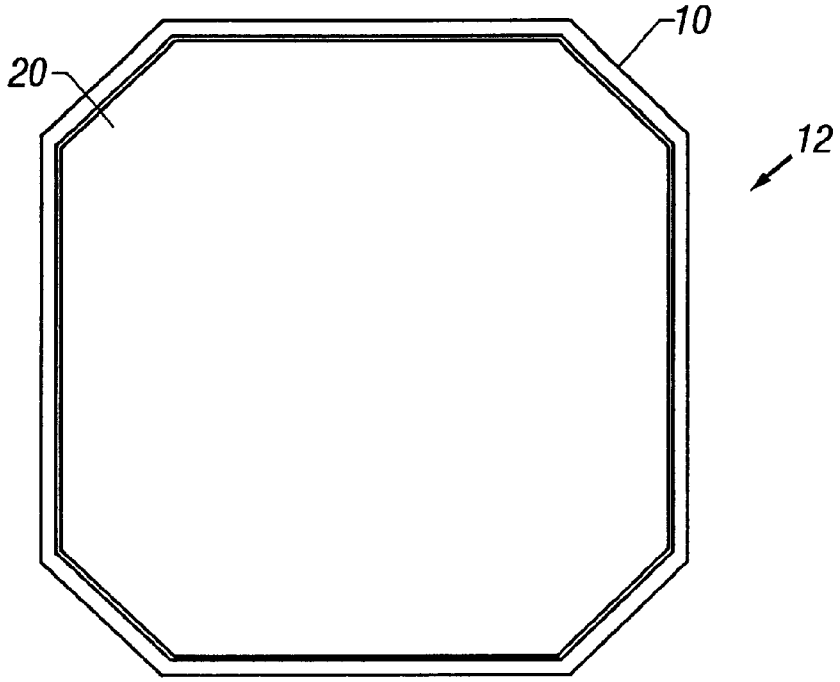
FIG. 1 is a top view of the snare drum simulator practice pad of the present invention.
Figure 2:
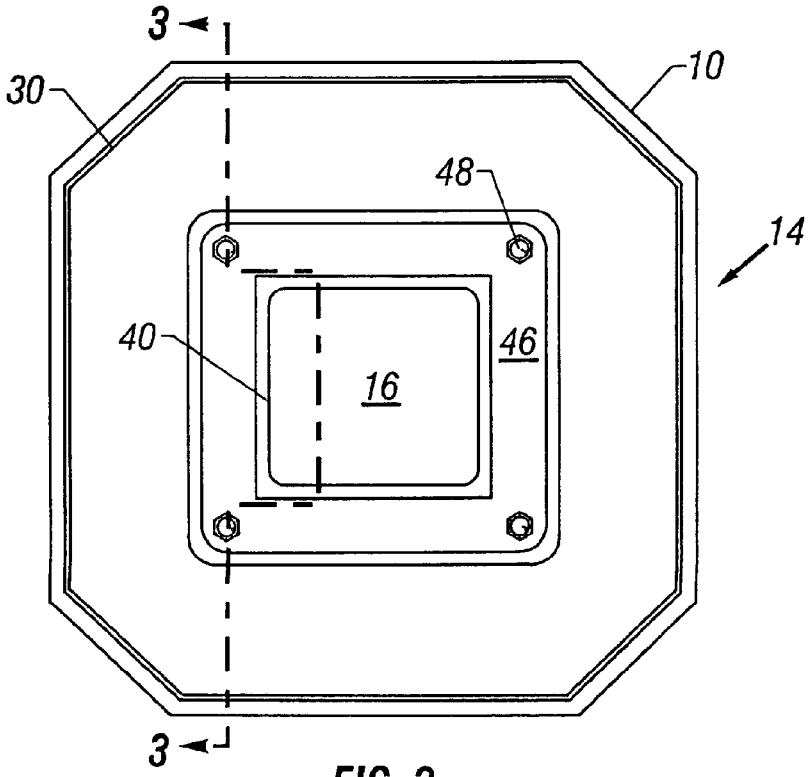
FIG. 2 is a bottom view of the snare drum simulator practice pad of the present invention.
Figure 3:
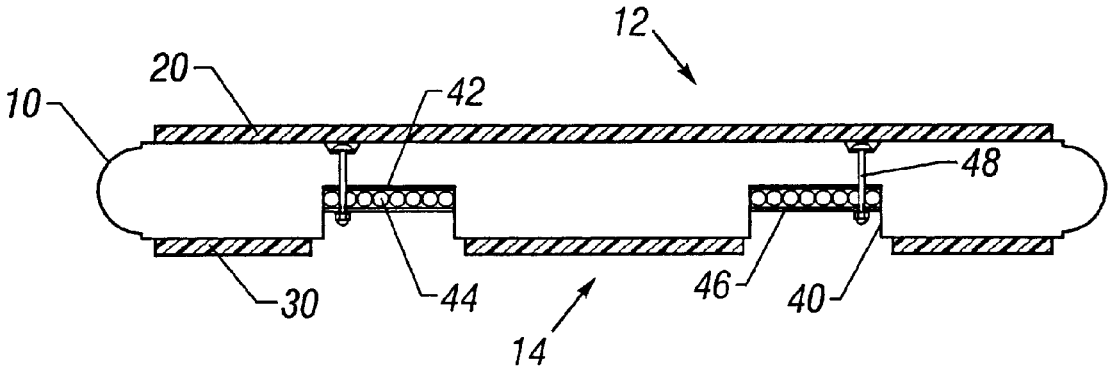
FIG. 3 is a side view, in section, of the snare drum simulator practice pad of the present invention along lines 2—2 of FIG. 2.

The present invention is directed to a novel apparatus that reproduces the sound and feel of a snare drum and allows a person to practice using a snare drum in a quieter and more easily transportable manner with a high degree of realism. The present invention addresses the shortcomings inherent in the prior art by providing a practice pad that can reproduce the sound and feel of an actual snare drum, thereby allowing the user to practice proper rhythm and technique to produce the desired results when using an actual snare drum.

The preferred embodiment of the practice pad of the present invention consists of a substrate 10 with a top surface 12 and bottom surface 14, the bottom surface 14 having a center point 16. A rubber pad 20 is attached to the top surface 12. The bottom surface 14 has a recessed channel 40 that contains a first plate 42 in generally the same shape as the recessed channel 40, a layer of pellets 44, and second plate 46 in generally the same shape as the recessed channel 40. The first plate 42, layer of pellets 44, and second plate 46 are all secured by a securing means 48 in the recessed channel 40 so as to allow little more than vibrational movement of the layer of pellets 44 against the plates 42 and 44 in the recessed channel 40. An open-cell sponge 30 is attached to the bottom surface 14, so as to not cover any portion of the recessed channel 40.

The substrate 10 can be made of any material that provides a stable, durable substrate, but is preferably made from a light, low-density wood such as poplar. Poplar wood is preferable because of the resonance and tonal qualities imparted to the vibrations generated by the drumming action. The use of poplar produced the highest quality snare drum sound of all of the materials tested. It is believed that this is because the poplar wood itself produces a dead sound and therefore transfers nearly all of the vibrations to the plates, 42 and 46, and layer of pellets 44.

The preferred embodiment shown in the figures is in a square shape, however, the present invention operates equally as well where the substrate 10 is in other shapes, i.e., rectangular, round, triangular, or any other polygon. Actual dimensions of the substrate 10 are not important to the operation of the present invention. However, the depth of the substrate 10 is preferably not more than one or two inches so as to maintain the plates, 42 and 46 and layer of pellets 44 in close proximity to the top surface 12, i.e., the drumming surface.

The rubber pad 20 attached to the top surface 12 is preferably made from semi-rigid rubber typically used in prior art practice pad devices. The open-cell sponge 30 attached to the bottom surface 14 is made from a resilient material typical of prior art practice pad devices and provides a non-skid surface so that the practice pad will not move during use. Both the rubber pad 20 and the open-cell sponge 30 are secured to the substrate 10 by an adhesive material. The preferred embodiment uses a double sided adhesive tape, but can just as easily use rubber cement or any other adhesive glue. The open-cell sponge 30 should not cover the recessed channel 40 because to do so would dampen the sound produced and lessen the tonal quality of the snare drum sound.

The recessed channel 40 in the bottom surface 14 of the substrate 10 can be in any shape. The recessed channel 40 and be formed as a straight groove in the bottom surface 14 that passed through the center point 16. Preferably, the recessed channel 40 is in any polygonal shape that surrounds the center point 16 of the bottom surface 14. The preferred embodiment shown in the figures shows the recessed channel 40 in a square shape having a square cross-section and leaving a plateau in the center of the bottom surface 14. The use of a polygonal shape surrounding the center point 16 and leaving a plateau provides a more stable substrate 10 while increasing the amount of sound generating pellets 44 in the device.

The first plate 42 is placed in the bottom of the recessed channel 40 in contact with the substrate 10. In the preferred embodiment, the first plate 42 is nearly identical in size and shape to the recessed channel 40. The first plate 42 should be made of a rigid material that will vibrate when a drumming motion is used on the present invention. Preferably, the first plate 42 is made of a metal, steel has been found to have the best tonal qualities for the present invention.

The layer of pellets 44 are placed onto the recessed channel 40 after the first plate 42 in direct contact with the first plate 42. The layer of pellets 44 are in sufficient number to completely cover the exposed surface of the first plate 42 but still allow slight movement of the pellets 44 against the first plate 42, the second plate 46 and the other pellets 44. The pellets 44 should be spherical and made of a metal similar to the first plate 42. In the preferred embodiment, the pellets 44 are made from steel.

The second plate 46 is placed in the recessed channel 40 after the layer of pellets 44 in direct contact with the pellets 44. In the preferred embodiment, the second plate 46 is identical in size and shape to the first plate 42, which is nearly identical in size and shape to the recessed channel 40. As with the first plate 42, The second plate 46 should be made of a rigid material that will vibrate when a drumming motion is used on the present invention. Preferably, the second plate 46 is made of a metal, steel has been found to have the best tonal qualities for the present invention.

The first plate 42, the layer of pellets 44, and the second plate 46 comprise the sound generating device of the present invention that, in connection with the sound qualities of the substrate 10, simulates the sound of a snare drum. The first plate 42, the layer of pellets 44, and the second plate 46 are all secured in the recessed channel 40 by a securing means 48. The preferred embodiment depicted in the figures shows the securing means 48 as four bolts at each corner of the recessed channel 40 that pass through the substrate 10 and are secured against the top surface 12 and covered by the rubber pad 20. However, the securing means can take any form that is sufficient to retain the plates, 42 and 46, as well as the layer of pellets 44 in the recessed channel 40. Such other means include posts inserted into the substrate 10 in the side walls of the recessed channel 40, barbs on the sides of the second plate 42 that secure themselves to the side walls of the recessed channel 40, or any other similar securing means 48 now known or to be developed.

The tension used in the securing means 48, regardless of the securing device, is important to the operation of the preferred embodiment. The plates, 42 and 46, and the layer of pellets 44 should only be secured with sufficient tightness to limit vertical movement of the plates, 42 and 46, in relation to the substrate 10 to merely vibrational movement. In addition, the pellets 44 should also only be under enough tension to only secure the pellets 44 but still allow vibrational movement against both plates, 42 and 46, and the other pellets 44.

In use, a person begins a "drumming" motion on the rubber pad 20. The vibrations from the rubber pad 20 are transferred to the substrate 10 which in turn transfers the vibrations to the first plate 42, the layer of pellets 44, and the second plate 46. The vibration of the layer of pellets 44 against the other pellets 44 and the plates, 42 and 46, is what generates the simulation of the snare drum sound.

The above-described preferred embodiment is intended to illustrate the principles of the invention, but not to limit its scope. Other embodiments and variations to this preferred embodiment will be apparent to those skilled in the art and may be made without departing from the spirit and scope of the invention as defined in the following claims.

I claim:

1. An apparatus for simulating the use of a snare drum comprising:

a) a substrate having a top surface and a bottom surface, said bottom surface having a center point;

b) a rubber pad connected to the top surface;

c) the bottom surface having a recessed channel located proximate to the center point of the bottom surface;

d) a first plate contained in the recessed channel and in physical contact with the substrate;

e) a layer of pellets in the recessed channel and in physical contact with the first plate; and f) a second plate in the recessed channel and in physical contact with the layer of pellets.

2. The apparatus according to claim 1 wherein the substrate is made of wood.

3. The apparatus according to claim 2 wherein the substrate is made from poplar wood.

4. The apparatus according to claim 1 wherein the recessed channel is in the shape of a polygon proximate to the center point of the bottom surface.

5. The apparatus according to claim 4 wherein the recessed channel is in the shape selected from the group consisting of a circle, a rectangle, a triangle, and a square.

6. The apparatus according to claim 1 wherein the first plate and the second plate are identical in shape to the recessed channel.

7. The apparatus according to claim 5 wherein the first plate and the second plate are identical in shape to the recessed channel.

8. The apparatus according to claim 1 wherein the first plate and the second plate are made from steel.

9. The apparatus according to claim 1 wherein the layer of pellets are spherical in shape.

10. The apparatus according to claim 1 wherein the layer of pellets are made from steel.

11. An apparatus for practicing the use of a snare drum comprising:

a) a wooden substrate having a top surface and a bottom surface, said bottom surface having a center point;

b) a rubber pad connected to the top surface;

c) the bottom surface having a recessed channel polygonal in shape and located proximately to the center point of the bottom surface;

d) a first steel plate identical in shape to the recessed channel contained in the recessed channel and in physical contact with the wooden substrate;

e) a layer of spherical, steel pellets in the recessed channel and in physical contact with the first plate; and f) a second steel plate identical in shape to the recessed channel in the recessed channel and in physical contact with the layer of pellets.

12. The apparatus according to claim 11 wherein the substrate is made from poplar-wood.

13. The apparatus according to claim 11 wherein the recessed channel is in the shape selected from the group consisting of a circle, a rectangle, a triangle, and a square.

14. An apparatus for practicing the use of a snare drum comprising:

a) a poplar-wood substrate having a top surface and a bottom surface, said bottom surface having a center point;

b) a rubber pad connected to the top surface;

c) the bottom surface having a recessed channel in a shape selected from the group consisting of a circle, a rectangle, a triangle, and a square and located proximately to the center point of the bottom surface;

d) a first steel plate identical in shape to the recessed channel contained in the recessed channel and in physical contact with the wooden substrate;

e) a layer of spherical, steel pellets in the recessed channel and in physical contact with the first plate; and f) a second steel plate identical in shape to the recessed channel in the recessed channel and in physical contact with the layer of pellets.

* * * * *